US006394676B1

(12) United States Patent
Dresher

(10) Patent No.: US 6,394,676 B1
(45) Date of Patent: May 28, 2002

(54) MEDIA SENSOR SYSTEM FOR PRINTER MECHANISM

(75) Inventor: John Joseph Dresher, West Carrollton, OH (US)

(73) Assignee: Premark FEG L.L.C., Wilmington, DE (US)

( * ) Notice: Subject to any disclaimer, the term of this patent is extended or adjusted under 35 U.S.C. 154(b) by 0 days.

(21) Appl. No.: 09/501,868

(22) Filed: Feb. 10, 2000

(51) Int. Cl.[7] ..... B41J 29/18
(52) U.S. Cl. ..... 400/703; 400/706
(58) Field of Search ..... 400/703, 708, 400/709.1, 711, 716, 582, 621, 621.2; 347/234, 236, 238, 253, 262, 264, 105; 250/559.29, 559.3, 227.14, 206.2, 206.1; 101/288

(56) References Cited

U.S. PATENT DOCUMENTS

| | | | | | |
|---|---|---|---|---|---|
| 3,854,566 | A | * | 12/1974 | Ellis | 197/176 |
| 4,082,595 | A | | 4/1978 | Slater | 156/351 |
| 4,189,337 | A | | 2/1980 | Higgins et al. | 156/351 |
| 4,201,617 | A | | 5/1980 | Orsinger et al. | 156/351 |
| 4,281,244 | A | | 7/1981 | Murata et al. | |
| 4,385,958 | A | | 5/1983 | Long | 156/361 |
| 4,497,420 | A | | 2/1985 | Stelcher et al. | 221/13 |
| 4,639,287 | A | | 1/1987 | Sakura | 156/361 |
| 4,642,655 | A | * | 2/1987 | Sparer et al. | 346/76 |
| 4,680,080 | A | * | 7/1987 | Instance | 156/324 |
| 4,685,982 | A | | 8/1987 | Kucheck | 156/64 |
| 4,691,100 | A | * | 9/1987 | Kizu et al. | 250/223 R |
| 4,727,437 | A | * | 2/1988 | Mizoguchi | 358/304 |
| RE33,260 | E | * | 7/1990 | Stephenson | 346/76 |
| 4,988,221 | A | * | 1/1991 | Shibayama et al. | 400/61 |
| 5,094,708 | A | | 3/1992 | Bechtel et al. | 156/351 |
| 5,133,396 | A | | 7/1992 | Selak et al. | 156/361 |
| 5,141,585 | A | | 8/1992 | Shinno et al. | 156/350 |
| 5,181,137 | A | * | 1/1993 | Koide | 359/21 |
| 5,266,967 | A | * | 11/1993 | Maslanka et al. | 346/76 |
| 5,336,003 | A | | 8/1994 | Nagashima et al. | 400/708 |
| 5,582,663 | A | | 12/1996 | Matsunaga | 156/64 |
| 5,653,846 | A | | 8/1997 | Onodera et al. | 156/362 |
| 5,725,719 | A | | 3/1998 | Szczepaniec et al. | 156/353 |
| 5,766,389 | A | | 6/1998 | Brandon et al. | 156/64 |
| 5,779,830 | A | | 7/1998 | Wakefield et al. | 165/64 |
| 5,823,692 | A | * | 10/1998 | Tolrud et al. | 400/582 |
| 5,936,656 | A | * | 8/1999 | Yamaguchi | 347/234 |
| 5,977,533 | A | * | 11/1999 | Clayton | 250/205 |
| 6,121,993 | A | * | 9/2000 | Mackawara et al. | 347/236 |
| 6,202,727 | B1 | * | 3/2001 | Yisha et al. | 156/538 |

FOREIGN PATENT DOCUMENTS

| | | |
|---|---|---|
| EP | 0397124 | 5/1990 |

* cited by examiner

*Primary Examiner*—Daniel J. Colilla
*Assistant Examiner*—Darius N. Cone
(74) *Attorney, Agent, or Firm*—Thompson Hine LLP

(57) ABSTRACT

A media sensor system includes a light source directing light towards media stock, a photo-detector positioned to detect light reflected from the media stock and a photo-detector positioned to detect light passing through the media stock. The light source and photo-detectors may be positioned in a media stock guide. The energization level of the light source and the photo-detector monitored may be set according to a media type being used.

15 Claims, 3 Drawing Sheets

MEDIA SENSOR SYSTEM FOR PRINTER MECHANISM

TECHNICAL FIELD

The present invention relates generally to optical print head media sensors used for detecting movement of media stock and, more particularly, to a media sensor system for a label printer mechanism, which media sensor system is configurable for detecting multiple types of label stock.

BACKGROUND OF THE INVENTION

Label printing mechanisms commonly utilize a media stock in the form of a roll of a backing material with the label secured thereto, where the label can be easily peeled from the backing material after passing by a print head which is used to print information on the label. Of course, even with label printer mechanisms various types of label stock are commonly available for use in association with the printer mechanism. For example, a first type of media stock may commonly be used with a given printer mechanism in the United States while another type of label stock may be more commonly used or even required in foreign countries. Proper detection and feed of the different types of label or media stock utilizing a given printer mechanism often proves difficult.

Prior art printer mechanisms have used optical techniques for detecting label stock movement. However, to date no printer mechanism has provided a sensor arrangement which provides a selection capability according to the type of media stock to be used.

Accordingly, it would be advantageous to provide a printer mechanism with a media sensor system which permits a printer mechanism to be configured for use with various types of media stock.

SUMMARY OF THE INVENTION

In one aspect of the invention, a printer media sensor system includes a media stock guide having a first guide rail and a second guide rail spaced apart to allow media stock to pass therebetween. A light source is positioned on the first guide rail and passing to direct light toward the second guide rail. A first photo-detector is positioned on the first guide rail and positioned for detecting light emitted from the light source and reflected from media stock passing between the first and second guide rails. A second photo-detector is positioned on the second guide rail and positioned for detecting light emitted from the light source and passing through the media stock. Either photo-detector may be selected for use in monitoring movement of media stock enabling a printer mechanism including the media sensor system to be configured for use with various types of media stock.

In another aspect of the invention, a method of tracking media stock movement in a printer mechanism includes providing a light source for directing light toward media stock, providing a first photo-detector for detecting light reflected from media stock, and providing a second photo-detector for detecting light transmitted through media stock. An energization level of the light source is selectively controlled based upon a type of media stock being used in the printer mechanism. Similarly, it is preferred that movement of a media stock feed roller is controlled according to signals received from the first photo-detector when a first media stock type is used in the printer mechanism, and movement of the media stock feed roller is controlled according to signals received from the second photo-detector when a second media stock type is used in the printer mechanism.

In a further aspect of the present invention, a method of configuring a printer mechanism for use with one of a plurality of media stocks involves providing a light source for directing light toward media stock. A first photo-detector is provided for receiving light emitted from the light source and reflected from media stock. A second photo-detector is provided for receiving light emitted from the light source and transmitted through media stock. A type of media stock to be used in the printer mechanism is identified. An energization level of the light source is set based upon the identified media stock type, and one of the photo-detectors is selected for monitoring based upon the identified media stock type.

DETAILED DESCRIPTION

Figure 1:
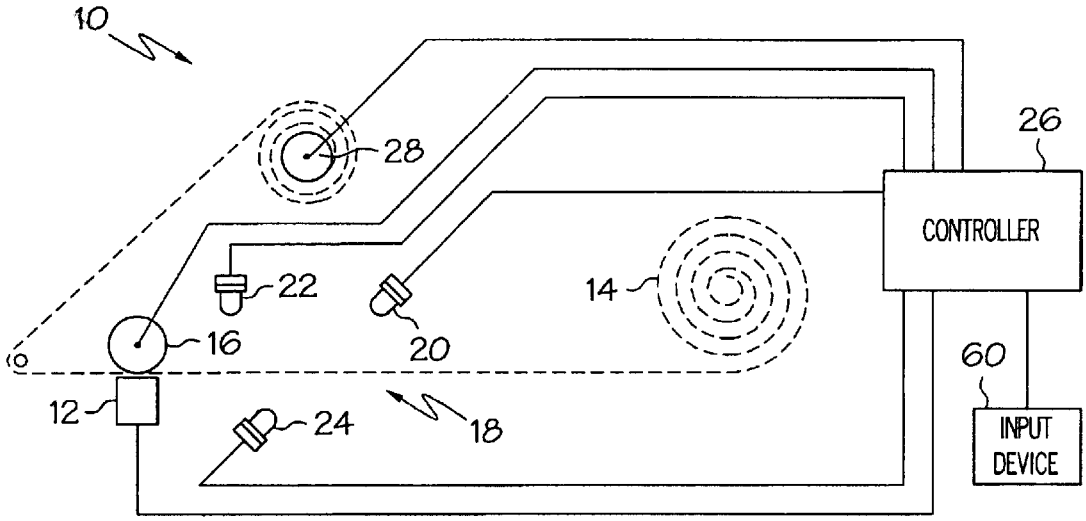
FIG. 1 is a high level schematic of a media sensor system according to one embodiment of the present invention.

Referring to FIG. 1, a schematic view of an exemplary printer mechanism 10 is shown including a print head 12. A roll of label or media stock 14 passes by the print head 12 for being imprinted upon, movement of the roll of media stock 14 being achieved via rotation of a feed roller 16 such as by a motor (not shown). Where label stock is used, the labels are positioned on the surface of the backing material which faces the print head 12. A media sensor system 18 (shown schematically) includes a light source 20 for directing light onto the media stock, a photo-detector 22 for detecting light reflected from the media stock, and a photo-detector 24 for detecting light transmitted through the media stock. It is understood that the light source 20 and photo-detectors 22 and 24 are preferably positioned in a similar plane across the width of the media as opposed to the depiction of FIG. 1 which is merely for ease of understanding. The light source 20 is preferably a narrow-band emitter (LED) and the photo-detectors are likewise preferably narrow-band detectors. An electronic controller 26 is connected for controlling/driving the energization of the light source 20 and for receiving signals from the photo-detectors 22 and 24. In response to signals received from one of the photo-detectors, the electronic controller 26 is operable to control movement of the feed roller 16, movement of a take up roll 28, and printing operations of the print head 12 such that printing takes place in desired positions relative to the media stock. For example, where the printer mechanism is a label printer, the feed roller 16 and print head 12 are controlled such that all printing takes place on the labels which are positioned on a backing material of the label stock.

Figure 2:
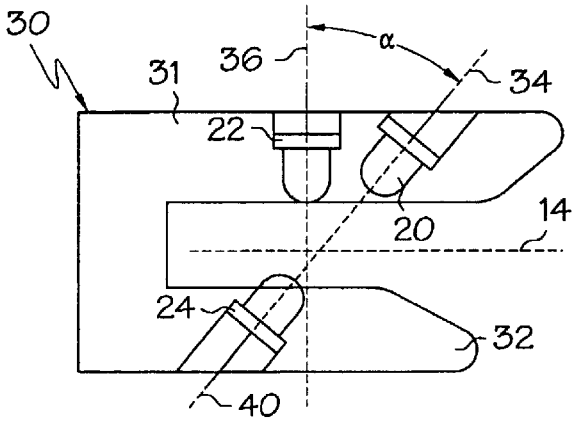
FIG. 2 is a cross-sectional view of a media stock guide according to one embodiment of the present invention.

Referring now to FIG. 2, in a preferred embodiment of the invention the media sensor system 18 is positioned in a media stock guide 30 as shown, which guide is commonly placed proximate to the print head 12 along the defined path of the media stock 14. The media stock guide 30 has a generally u-shaped cross-sectional configuration, including a guide rail 31 and a guide rail 32, where the media stock 14 passes between the two rails in a direction into or out of the paper relative to FIG. 2. The light source 20 is recessed within the first guide rail 31 and positioned to direct light towards the second guide rail as indicated by line of sight 34, so that the light impinges upon the media stock 14. The photo-detector 22 is recessed within the first guide rail 31 and is positioned for detecting light emitted from the light source 20 and reflected from media stock positioned between the first and second guide rails. The second photo-detector 24 is recessed within the second guide rail 32 and positioned for detecting light emitted from the light source 20 and passing through media stock 14. Preferably, a line of sight 36 of the photo-detector 22 intersects the line of sight 34 of the light source 20 at an angle $\alpha$ of about forty degrees. A line of sight 40 of the photo-detector 24 is substantially coincident with the line of sight 34 for detecting the light transmitted through the media stock 14. The photo-detector 24 may preferably extend partially from the guide rail 32 to improve detection and to avoid paper dust collecting on the detector.

Figure 3:
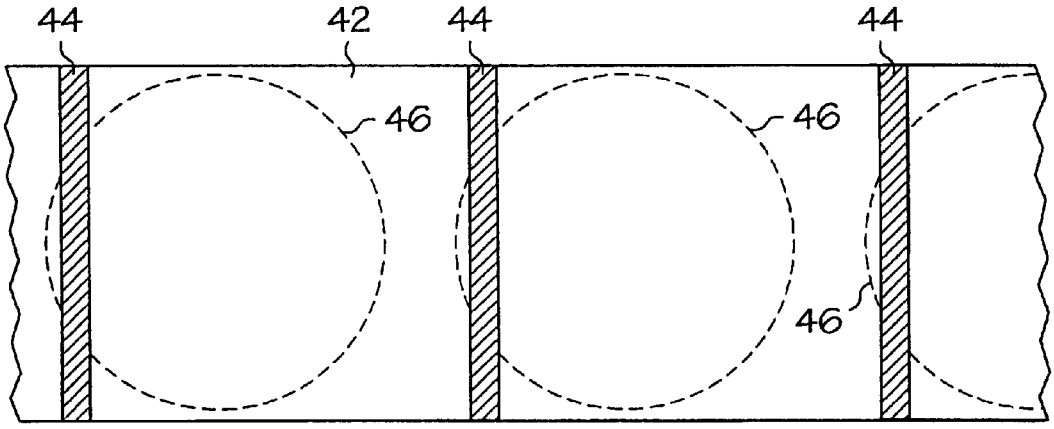
FIG. 3 depicts an exemplary printer label stock.

One type of label stock, shown in FIG. 3, includes backing 42 with labels 46 (shown in shadow) being attached to the opposite side of backing 42. The surface of backing 42 includes spaced black bars 44, each located in a similar position relative to a respective label 46. This "black bar" type label stock is commonly used for labels having a leading edge which does not extend substantially to the edge of the backing 42. Where the labels are more rectangular in shape, the black bars on the backing 42 are sometimes eliminated.

Referring again to FIGS. 1 and 2, in operation, the electronic controller 26 is utilized in combination with one of the photo-detectors 22 and 24 to control movement of the media stock 14 and printing thereon. In particular, the controller 26 is operable to set an energization level of the light source 20 according to the media type being used. For example, in a label printer mechanism if a black bar type label stock is used, the light source 20 will be energized at a level suited for such label stock and the photo-detector 22 will be used to detect the presence or absence of light reflected from the rear surface of the backing 42. The output of the photo-detector 22 provides output signals indicative of the black bar location and thus the label location. On the other hand, when a label stock which does not include the series of spaced black bars imprinted thereon is used ("black bar free"), the reflective type sensor is not particularly helpful because the amount of light reflected from the blank rear surface of the backing is substantially constant. Therefore, with such black bar free label stock the light source is energized at a different level which is best suited for detecting light transmitted through the label stock with photo-detector 24. The amount of light transmitted through the stock, and thus the level of the output signal from the photo-detector 24, varies from when the light is transmitted through just the backing material to when the light is transmitted through the backing material and a label.

Accordingly, in both situations, regardless of whether the photo-detector 22 is used or the photo-detector 24 is used, the position of the labels can be determined by the controller 26, and the feed roller 16, take up roll 28 and print head 12 can be controlled accordingly. The media sensor system 18 therefore provides the ability to selectively control the energization level of the light source 20 and which photo-detector 22 or 24 is monitored according to the media type being used, making the printer mechanism better suited for use with multiple media types. The media sensor system can be configured for operation with only one type of label stock if desired, such as when it is known that a given printer mechanism will only be used with one type of label stock.

Figure 4:
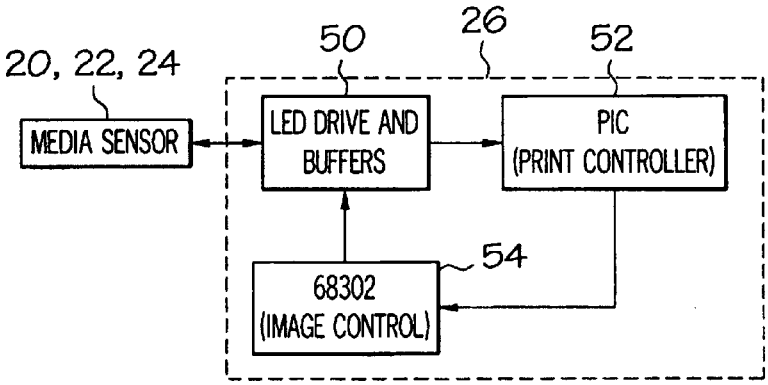
FIG. 4 is a block diagram view of one embodiment of the electronic controller of FIG. 1.

A high level block diagram representation of one embodiment of electronic controller 26 is depicted in FIG. 4. The electronic controller 26 includes a light source drive and buffer portion 50 connected to the light source 20 and photo-detectors 22 and 24, a print controller 52 connected to the buffer portion for receiving photo-detector signals therefrom, and an image controller 54 connected to the print controller 52 for receiving photo-detection level indicative signals therefrom.

The light source drive and buffer portion 50 preferably includes an LED drive circuit having a transistor for varying the current delivered to the LED light source 20 and thus the energization level thereof PWM type control may be used. The buffers within portion 50 may comprise a collector resistor and an op amp to condition the analog output signal of the photo-detectors to an appropriate output impedance. The print controller 52 contains the A/D converters needed to convert the buffered photo-detector signals to digital signals which can be processed. The print controller 52 passes the digitized photo-detector signals to the image controller 54. The image controller 54 controls an EE Potentiometer in the LED drive circuit which sets the current level through the light source. The image controller 54 utilizes the digital photo-detector signals received from the print controller when adjusting or setting the drive energization of the light source 20.

Figure 5:
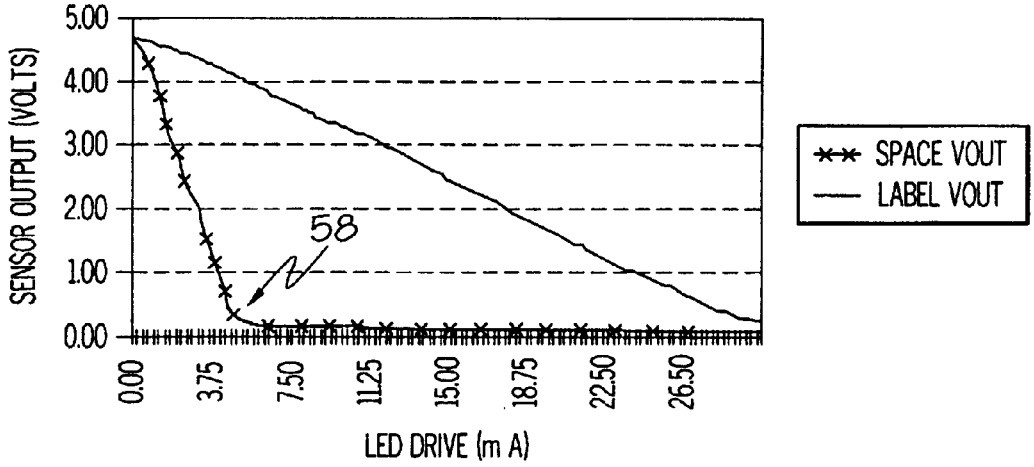
FIG. 5 is a calibration graph for the media sensor system.

In order to establish the appropriate energization level of the light source 20 for given media stock types, the controller 26 is operable in a calibration mode to run through a light source energization sequence. In particular, referring to FIG. 5, for a label stock having no series of black bars, the transmissive photo-detector 24 output is monitored as the current through the light source is varied from zero to some predetermined level. This monitoring is done when the label stock is positioned so that the light travels through only the backing material (identified as "Space" in FIG. 5). Based upon this calibration sequence an energization level for the light source which provides an optimum distinction between the "Space" and the "Label" can be determined and stored in memory of the controller 26 for retrieval and use by the controller 26 when label stock of that type is being used in the printer mechanism. Preferably, the energization level is set to the mA rating which is just to the right of the bend 58 in the Space curve.

Figure 6:
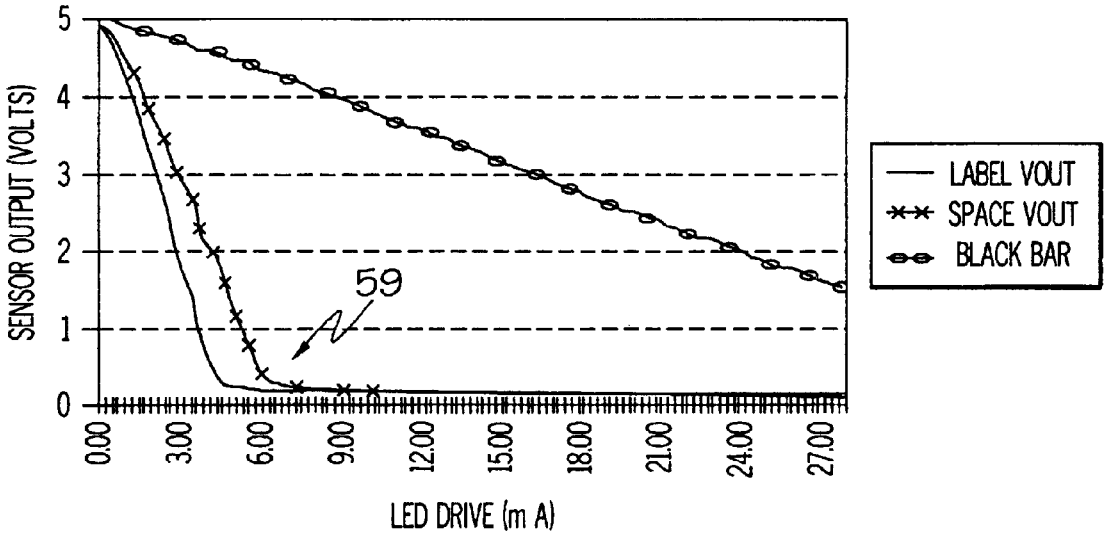
FIG. 6 is a calibration graph for the media sensor system.

Similarly, referring to FIG. 6, for a label stock having the spaced black bars thereon the reflective photo-detector 22 output is monitored as the current through the light source is varied from zero to some predetermined level. This monitoring is done when the label stock is positioned so that the light reflects only from the backing material (identified as "Space" in FIG. 6). Based upon this calibration an energization level for the light source which provides an optimum distinction between the "Black Bar" and the "Label" and "Space" can be determined and stored in memory of the controller 26 for retrieval and use by the controller 26 when label stock of that type is being used in the printer mechanism. Preferably, the energization level is set to the mA rating which is just to the right of the bend 59 in the Space curve.

The aforementioned calibrations can be completed at the manufacturing stage of the printer mechanism and can be done for one or more different media stock types. Thus, a printer mechanism including the described media sensor system may be pre-configured to operate with just one media type, or may be pre-configured to operate with more than one media type. In the latter case, referring again to FIG. 1, an input device 60 such as user input keys, or a user operated switch, or system controller which controls other functions of the printer may be used to deliver a signal to the controller 26 which indicates the type of label stock being used in the printer mechanism. For example, when a user switches media stock types the controller may query the user using a display screen (not shown) for the type of media stock being used. Alternatively, the printer mechanism may be equipped with a sensor which automatically reads some type of code on the media stock roll or an associated media cassette to determine the type of media stock being used and correspondingly set both the energization level of the light source and which photo-detector to monitor. Calibration operations can also be performed during maintenance or servicing of the printer mechanism.

Thus, in operation, a method of sensing media stock movement in a printer mechanism is provided, where the method includes the steps of providing a light source for directing light toward media stock, providing a photo-detector for detecting light reflected from media stock, and providing a photo-detector for detecting light transmitted through media stock. An energization level of the light source is controlled based upon a type of media stock being used in the printer mechanism. Movement of a media stock feed roller is controlled according to signals received from the reflective photo-detector when a black bar type media stock type is used in the printer mechanism, and movement of the media stock feed roller is controlled according to signals received from the transmissive photo-detector when a black bar free media stock type is used in the printer mechanism.

Although the invention has been described above in detail referencing the preferred embodiments thereof, it is recognized that various changes and modifications could be made without departing from the spirit and scope of the invention.

What is claimed is:

1. A printer media sensor system, comprising:

a media stock guide having a first guide rail spaced from a second guide rail for allowing media stock to pass there between;

a light source positioned on the first guide rail and positioned to direct light toward the second guide rail;

a first photo-detector positioned on the first guide rail and positioned for detecting light emitted from the light source and reflected from media stock passing between the first and second guide rails; and a second photo-detector positioned on the second guide rail and positioned for detecting light emitted from the light source and passing through media stock passing between the first and second guide rails.

2. The printer media sensor system of claim 1 wherein the light source directs light toward media stock in a direction defined by a first line of sight, and a second line of sight of the first photo-detector intersects the first line of sight at an angle of about forty degrees.

3. The printer media sensor system of claim 2 wherein a third line of sight of the second photo-detector is substantially coincident with the first line of sight.

4. The printer media sensor system of claim 1, further comprising: an electronic controller connected for controlling energization of the light source and for receiving signals from the first and second photo-detectors.

5. The printer media sensor system of claim 4, wherein the electronic controller includes associated memory, at least two different light source energization levels stored in memory, each corresponding to a media type, the controller operable to effect energization of the light source according to the media type being used.

6. The printer media sensor system of claim 5, further comprising:

an input device connected for providing a media type indicative signal to the electronic controller.

7. The printer media sensor system of claim 5 wherein the electronic controller comprises a light source driver connected to the light source, a buffer portion connected to the photo-detectors, a print controller connected to the buffer portion for receiving buffered photo-detector signals therefrom, and an image controller connected to the print controller for receiving photo-detection level indicative signals therefrom and connected to the light source driver for controlling the light source energization level.

8. The printer media sensor system of claim 4 wherein the electronic controller is connected to a feed roller for feeding media stock through the media stock guide, the electronic controller operable to control the feed roller in response to signals received from one of the first and second photo-detectors.

9. The print head media sensor system of claim 8 wherein the electronic controller is operable to control the feed roller in response to signals received from the first photo-detector when using a first media type including a series of spaced black bars imprinted thereon and wherein the electronic controller is operable to control the feed roller in response to signals received from the second photo-detector when using a second black bar free media type.

10. The print head media sensor system of claim 9, further comprising:

an input device connected for providing a media type indicative signal to the electronic controller.

11. A printer media sensor system, comprising:

a light source positioned to direct light towards media stock;

a first photo-detector positioned for receiving light emitted from the light source and reflected from the media stock;

a second photo-detector positioned for receiving light emitted from the light source and passing through the media stock; and an electric controller connected for controlling energization of the light source and for receiving signals from the first and second photo-detectors, the electronic controller controlling an energization level of the light source according to a known media type being used, where a first energization level of the light source is set if the known media type is a first media type and a second energization level of the light source is set if the known media type is a second media type, the first energization level being different than the second energization level;

wherein the electronic controller is connected to a feed roller for feeding media stock past a print head, the electronic controller operable to control the feed roller in response to signals received from one of the first and second photo-detectors.

12. A method of configuring a printer mechanism for use with one of a plurality of media stocks, the method comprising the steps of:

providing a light source for directing light toward media stock;

providing a first photo-detector for receiving light emitted from the light source and reflected from media stock;

providing a second photo-detector for receiving light emitted from the light source and transmitted through media stock;

identifying a type of media stock to be used in the printer mechanism;

setting an energization level of the light source based upon the identified media stock type; and selecting which photo-detector to monitor based upon the identified media stock type.

13. A printer media sensor system, comprising:

a light source positioned to direct light towards media stock;

a first photo-detector positioned for receiving light emitted from the light source and reflected from the media stock;

a second photo-detector positioned for receiving light emitted from the light source and passing through the media stock;

an electronic controller connected for controlling energization of the light source and for receiving signals from the first and second photo-detectors, the electronic controller operable to control an energization level of the light source according to the media type being used;

wherein the electronic controller is connected to a feed roller for feeding media stock past a print head, the electronic controller operable to control the feed roller in response to signals received from one of the first and second photo-detectors; and wherein the electronic controller is operable to control the feed roller in response to signals received from the first photo-detector when using a first media type including a series of spaced black bars imprinted thereon and wherein the electronic controller is operable to control the feed roller in response to signals received from the second photo-detector when using a second black bar free media type.

14. A method of sensing media stock movement in a printer mechanism, the method comprising the steps of:

providing a light source for directing light toward media stock;

providing a first photo-detector for detecting light reflected from media stock;

providing a second photo-detector for detecting light transmitted through media stock;

controlling an energization level of the light source based upon a type of media stock being used in the printer mechanism;

controlling movement of a media stock feed roller according to signals received from the first photo-detector when a First media stock type is used in the printer mechanism;

controlling movement of the media stock feed roller according to signals received from the second photo-detector when a second media stock type is used in the printer mechanism;

wherein the first media stock type comprises label stock having a series of spaced black bars imprinted thereon.

15. A method of sensing media stock movement in a printer mechanism, the method comprising the steps of:

providing a light source for directing light toward media stock;

providing a first photo-detector for detecting light reflected from media stock;

providing a second photo-detector for detecting light transmitted through media stock; and determining a type of media stock inserted in the printer mechanism;

retrieving from memory a stored light source energization level for the determined media stock type;

controlling an energization level of the light source based upon the determined type of media stock according to the stored energization level retrieved from memory.

* * * * *